US007056393B2

(12) United States Patent
Tokuhara et al.

(10) Patent No.: US 7,056,393 B2
(45) Date of Patent: Jun. 6, 2006

(54) METHOD OF MAKING SINTERED COMPACT FOR RARE EARTH MAGNET

(75) Inventors: Koki Tokuhara, Hyogo (JP); Hitoshi Morimoto, Hyogo (JP)

(73) Assignee: Neomax, Co., Ltd., Osaka (JP)

( * ) Notice: Subject to any disclaimer, the term of this patent is extended or adjusted under 35 U.S.C. 154(b) by 409 days.

(21) Appl. No.: 10/381,007

(22) PCT Filed: May 28, 2002

(86) PCT No.: PCT/JP02/05171

§ 371 (c)(1),
(2), (4) Date: Mar. 20, 2003

(87) PCT Pub. No.: WO02/099823

PCT Pub. Date: Dec. 12, 2002

(65) Prior Publication Data

US 2004/0020563 A1 Feb. 5, 2004

(30) Foreign Application Priority Data

May 30, 2001 (JP) ..... 2001-163401

(51) Int. Cl.
*H01F 1/057* (2006.01)

(52) U.S. Cl. ..... 148/101; 148/102; 148/103; 148/104; 148/122; 419/12; 419/30; 419/33; 419/38

(58) Field of Classification Search ..... 148/101, 148/102, 103, 104, 122; 419/12, 30, 33, 419/38

See application file for complete search history.

(56) References Cited

U.S. PATENT DOCUMENTS

| | | | | |
|---|---|---|---|---|
| 4,770,723 | A | 9/1988 | Sagawa et al. | |
| 4,792,368 | A | 12/1988 | Sagawa et al. | |
| 5,091,020 | A | 2/1992 | Kim | |
| 5,624,503 | A * | 4/1997 | Yamashita | 148/103 |
| 5,908,513 | A * | 6/1999 | Sasaki et al. | 148/302 |
| 5,930,582 | A * | 7/1999 | Ito et al. | 419/32 |
| 6,149,861 | A | 11/2000 | Kaneko et al. | |
| 6,468,365 | B1 * | 10/2002 | Uchida et al. | 148/302 |
| 6,491,765 | B1 | 12/2002 | Okayama et al. | |
| 2004/0050454 | A1 * | 3/2004 | Sekino et al. | 148/105 |

FOREIGN PATENT DOCUMENTS

| | | | |
|---|---|---|---|
| JP | 63-33505 | A | 2/1988 |
| JP | 6-96928 | * | 4/1994 |
| JP | 6-340902 | A | 12/1994 |

* cited by examiner

*Primary Examiner*—John P. Sheehan
(74) *Attorney, Agent, or Firm*—Keating & Bennett, LLP

(57) ABSTRACT

A method of making a sintered body for a rare earth magnet includes the steps of (a) preparing a first coarse powder by coarsely pulverizing a rare earth alloy sintered body by a hydrogen pulverization process, (b) preparing a first fine powder by finely pulverizing the first coarse powder, (c) preparing a second fine powder by pulverizing an alloy block of a rare earth alloy material, and (d) sintering a mixed powder including the first and second fine powders. The first and second fine powders each includes a main phase represented by $(LR_{1-x}HR_x)_2T_{14}A$, where T is Fe and/or at least one non-Fe transition metal element; A is boron and/or carbon; LR is at least one light rare earth element; HR is at least one heavy rare earth element; and $0 \leqq x < 1$.

10 Claims, No Drawings

METHOD OF MAKING SINTERED COMPACT FOR RARE EARTH MAGNET

BACKGROUND OF THE INVENTION

1. Field of the Invention

The present invention relates to a method of making a sintered body for a rare earth magnet, and more particularly, the present invention relates to a method of making a sintered body for use in, for example, an R—Fe—B type magnet.

2. Description of the Related Art

A rare earth alloy sintered magnet (permanent magnet) is normally produced by compacting a powder of a rare earth alloy, sintering the resultant compact and then subjecting the sintered body to an aging treatment. To be a sintered magnet, the sintered body may be magnetized at an arbitrary time after having been subjected to the aging treatment. It should be noted that the "rare earth alloy sintered body" used herein means either a sintered body to be magnetized or a sintered body that has already been magnetized (i.e., a sintered magnet) according to the context.

Permanent magnets currently used extensively in various applications include a samarium-cobalt (Sm—Co) type magnet and a neodymium-iron-boron (Nd—Fe—B) type magnet. Among other things, an R—Fe—B type magnet (where R is at least one element selected from the rare earth elements including yttrium (Y) and is typically neodymium (Nd), Fe is iron and B is boron) is used more and more often in various types of electronic appliances. This is because an R—Fe—B type magnet exhibits a maximum energy product $(BH)_{max}$ that is higher than any of various other types of magnets and yet, the R—Fe—B type magnet is relatively inexpensive.

An R—Fe—B type sintered magnet includes a main phase consisting essentially of a tetragonal $R_2Fe_{14}B$ compound, an R-rich phase including Nd, for example, and a B-rich phase. In an R—Fe—B type sintered magnet, a portion of Fe may be replaced with a transition metal element such as Co or Ni and a portion of B may be replaced with C. An R—Fe—B type sintered magnet, to which various preferred embodiments of the present invention are applicable, is described in U.S. Pat. Nos. 4,770,723 and 4,792,368, for example.

In the prior art, an R—Fe—B type alloy has been prepared as a material for such a magnet by an ingot casting process. In an ingot casting process, normally, rare earth metal, electrolytic iron and ferroboron alloy as respective start materials are melted by an induction heating process, and then the melt obtained in this manner is cooled relatively slowly in a casting mold, thereby preparing an alloy ingot.

Recently, a rapid quenching process such as a strip casting process or a centrifugal casting process has attracted much attention in the art. In a rapid quenching process, a molten alloy is brought into contact with, and relatively rapidly cooled and solidified by, the outer or inner surface of a single chill roller or a twin chill roller, a rotating chill disk or a rotating cylindrical casting mold, thereby making a rapidly solidified alloy, which is thinner than an alloy ingot, from the molten alloy. The rapidly solidified alloy prepared in this manner will be herein referred to as an "alloy flake". The alloy flake produced by such a rapid quenching process normally has a thickness of about 0.03 mm to about 10 mm. According to the rapid quenching process, the molten alloy starts to be solidified from a surface thereof that has been in contact with the surface of the chill roller. That surface of the molten alloy will be herein referred to as a "roller contact surface". Thus, in the rapid quenching process, columnar crystals grow in the thickness direction from the roller contact surface. As a result, the rapidly solidified alloy, made by a strip casting process or any other rapid quenching process, has a structure including an $R_2Fe_{14}B$ crystalline phase and an R-rich phase. The $R_2Fe_{14}B$ crystalline phase usually has a minor-axis size of about 0.1 μm to about 100 μm and a major-axis size of about 5 μm to about 500 μm. On the other hand, the R-rich phase, which is a non-magnetic phase including a rare earth element R at a relatively high concentration, is dispersed in the grain boundary between the $R_2Fe_{14}B$ crystalline phases.

Compared to an alloy made by the conventional ingot casting process or die casting process (such an alloy will be herein referred to as an "ingot alloy"), the rapidly solidified alloy has been quenched and solidified in a shorter time (i.e., at a quench rate of about $10^{2\circ}$ C./sec to about $10^{4\circ}$ C./sec). Accordingly, the rapidly solidified alloy has a finer structure and a smaller average crystal grain size. In addition, in the rapidly solidified alloy, the grain boundary thereof has a greater area and the R-rich phase is dispersed broadly and thinly in the grain boundary. Thus, the rapidly solidified alloy also excels in the dispersiveness of the R-rich phase. Because the rapidly solidified alloy has the above-described advantageous features, a magnet with excellent magnetic properties can be made from the rapidly solidified alloy.

An alternative alloy preparation method called "Ca reduction process (or reduction/diffusion process)" is also known in the art. This process includes the processing and manufacturing steps of: adding metal calcium (Ca) and calcium chloride (CaCl) to either the mixture of at least one rare earth oxide, iron powder, pure boron powder and at least one of ferroboron powder and boron oxide at a predetermined ratio or a mixture including an alloy powder or mixed oxide of these constituent elements at a predetermined ratio; subjecting the resultant mixture to a reduction/diffusion treatment within an inert atmosphere; diluting the reactant obtained to make a slurry; and then treating the slurry with water. In this manner, a solid of an R—Fe—B type alloy can be obtained.

It should be noted that any small block of a solid alloy will be herein referred to as an "alloy block". The "alloy block" may be any of various forms of solid alloys that include not only solidified alloys obtained by cooling a melt of a material alloy either slowly or rapidly (e.g., an alloy ingot prepared by the conventional ingot casting process or an alloy flake prepared by a quenching process such as a strip casting process) but also a solid alloy obtained by the Ca reduction process.

An alloy powder to be compacted is obtained by performing the processing steps of: coarsely pulverizing an alloy block in any of these forms by a hydrogen pulverization process, for example, and/or any of various mechanical milling processes (e.g., using a feather mill, power mill or disk mill); and finely pulverizing the resultant coarse powder (with a mean particle size of about 10 μm to about 500 μm) by a dry milling process using a jet mill, for example. The alloy powder to be compacted preferably has a mean particle size of about 1.5 μm to about 7 μm to achieve sufficient magnetic properties. It should be noted that the "mean particle size" of a powder herein refers to a mass median diameter (MMD) unless stated otherwise. The coarse powder may also be finely pulverized by using a ball mill or attritor.

A rare earth alloy powder is easily oxidizable, which is disadvantageous. A method of forming a thin oxide film on the surface of a rare earth alloy powder to avoid this problem was disclosed in Japanese Patent Gazette for Opposition No.

6-6728, which was originally filed by Sumitomo Special Metals Co., Ltd. on Jul. 24, 1986. According to another known method, the surface of a rare earth alloy powder may also be coated with a lubricant for that purpose. It should be noted that a rare earth alloy powder with no oxide film or lubricant coating thereon, a rare earth alloy powder covered with an oxide film and a rare earth alloy powder coated with a lubricant will all be referred to as a "rare earth alloy powder" collectively for the sake of simplicity. However, when the "composition of a rare earth alloy powder" is in question, the composition is that of the rare earth alloy powder itself, not the combination of the powder and the oxide film or lubricant coating.

Generally speaking, the material cost of the rare earth sintered magnet is relatively high. This is also true of an R—Fe—B type magnet including a lot of Fe as an inexpensive material. Thus, to cut down the material cost of the rare earth sintered magnet and not to waste valuable natural resources, methods of recycling defective rare earth alloy sintered bodies without remelting the sintered bodies have been researched and developed recently.

For example, Japanese Patent Publication No. 2746818 discloses a method of recycling a powder obtained by pulverizing the scrap of an Nd—Fe—B type alloy for a sintered magnet (which powder will be herein referred to as a "scrap powder"). In this method, the scrap powder of the Nd—Fe—B type alloy is mixed with a rare earth alloy powder (which is called "alloy B" in Japanese Patent Publication No. 2746818) to compensate for the oxidized portions of the material alloy and thereby improve the sinterability of the scrap powder.

Another method of recycling a scrap powder of an R—Fe—B type magnet is disclosed in Japanese Laid-Open Publication No. 11-329811. In that alternative method, an alloy powder, including an $Nd_2Fe_{14}B$ phase as its main phase, is prepared by subjecting the scrap powder of the R—Fe—B type magnet to acid cleaning and Ca reduction processes, for example, and then mixed with a composition controlling alloy powder to improve the sinterability thereof.

According to these conventional recycling methods, however, an alloy powder, having a composition that is essentially different from that of the alloy powder as a material for the intended rare earth alloy sintered body, should be prepared. That is to say, since the "alloy B" powder or the composition controlling alloy powder needs to be prepared, the overall manufacturing process is adversely complicated. In addition, it is difficult to make a sintered body for a rare earth magnet from the alloy B powder or the composition controlling alloy powder alone. Also, even if a magnet could be made from such a powder, the magnetic properties of that magnet would be significantly inferior to the desired magnetic properties.

SUMMARY OF THE INVENTION

In order to overcome the problems described above, preferred embodiments of the present invention provide a method of making a rare earth alloy sintered body by recycling a defective rare earth alloy sintered body more efficiently.

A preferred embodiment of the present invention provides a method of making a sintered body for a rare earth magnet. The method preferably includes the steps of (a) preparing a first coarse powder by coarsely pulverizing a rare earth alloy sintered body by a hydrogen pulverization process, (b) preparing a first fine powder by finely pulverizing the first coarse powder, (c) preparing a second fine powder by pulverizing an alloy block of a rare earth alloy material and (d) sintering a mixed powder including the first and second fine powders. Each of the first and second fine powders preferably includes a main phase having a composition represented by the general formula: $(LR_{1-x}HR_x)_2T_{14}A$, where T is either Fe alone or a mixture of Fe and at least one transition metal element other than Fe; A is either boron alone or a mixture of boron and carbon; LR is at least one light rare earth element; HR is at least one heavy rare earth element; and $0 \leqq x < 1$.

In one preferred embodiment of the present invention, the steps (b) and (c) preferably respectively include the steps of preparing the first and second fine powders each including about 25 mass % to about 40 mass % of rare earth element(s) R (where $R=LR_{1-x}HR_x$) and about 0.6 mass % to about 1.6 mass % of A. The balance of the first or second fine powder, other than R and A, preferably includes T, a very small amount of additive(s) and inevitably contained impurities. The very small amount of additive(s) is preferably at least one element selected from the group consisting of Al, Cu, Ga, Cr, Mo, V, Nb and Mn. The total amount of the additive(s) is preferably about 1 mass % or less. The resultant sintered body for a rare earth magnet preferably includes the rare earth element(s) R at about 34 mass % or less, more preferably at about 33 mass % or less.

In another preferred embodiment, the steps (a) and (c) preferably include the step of preparing the rare earth alloy sintered body and the step of preparing the alloy block of the rare earth alloy material, respectively. Each of the rare earth alloy sintered body and the alloy block of the rare earth alloy material preferably includes a compound represented by $(LR_{1-x}HR_x)_2T_{14}A$ at about 80 vol % or more.

In still another preferred embodiment, the method preferably further includes the step of making the mixed powder in which the mass of the first fine powder corresponds to about 0.1% to about 10% of the mass of the second fine powder.

In this particular preferred embodiment, the steps (b) and (c) preferably respectively include the steps of preparing the first and second fine powders such that a mole fraction x in the formula representing the main phase of the first fine powder is different from a mole fraction x in the formula representing the main phase of the second fine powder. And the method preferably further includes the step of making the mixed powder in which the mass of the first fine powder corresponds to less than about 5% of the mass of the second fine powder. To achieve sufficient magnetic properties, the mass of the first fine powder more preferably corresponds to less than about 3% of the mass of the second fine powder.

In still another preferred embodiment, the step (a) preferably includes the steps of crushing the rare earth alloy sintered body into a plurality of blocks, each having a mass of about 50 g or less and coarsely pulverizing each of the plurality of blocks by the hydrogen pulverization process.

In yet another preferred embodiment, the step (c) preferably includes the steps of preparing a second coarse powder by coarsely pulverizing the alloy block of the rare earth alloy material and producing the second fine powder by finely pulverizing the second coarse powder. And the method preferably further includes the steps of making a mixed powder of the first and second coarse powders, and producing the mixed powder of the first and second fine powders by finely pulverizing the mixed powder of the first and second coarse powders.

Alternatively, the step (c) may include the steps of preparing a second coarse powder by coarsely pulverizing the alloy block of the rare earth alloy material and producing the second fine powder by finely pulverizing the second coarse powder. The method may further include the steps of subjecting a mixture of the alloy block of the rare earth alloy material and the rare earth alloy sintered body to the hydrogen pulverization process to make a mixed coarse powder of the first and second coarse powders and producing the mixed powder of the first and second fine powders by finely pulverizing the mixed coarse powder.

In yet another preferred embodiment, the step (c) preferably includes the step of preparing the alloy block by solidifying a melt of the rare earth alloy material by a quenching process.

In yet another preferred embodiment, the step (a) preferably includes the step of coarsely pulverizing a defective sintered body for a rare earth magnet as the rare earth alloy sintered body.

Other features, elements, processes, steps, characteristics and advantages of the present invention will become more apparent from the following detailed description of preferred embodiments of the present invention.

DETAILED DESCRIPTION OF PREFERRED EMBODIMENTS

Hereinafter, preferred embodiments of the present invention will be described. The following specific preferred embodiments of the present invention relate to a method of making a sintered body for a rare earth magnet.

A method of making a sintered body for a rare earth magnet according to a preferred embodiment of the present invention preferably includes the steps of: (a) preparing a first coarse powder by coarsely pulverizing a rare earth alloy sintered body by a hydrogen pulverization process; (b) preparing a first fine powder by finely pulverizing the first coarse powder; (c) preparing a second fine powder by pulverizing an alloy block that has been obtained by cooling a melt of a rare earth alloy material; and (d) sintering a mixed powder including the first and second fine powders. Each of the first and second fine powders includes a main phase having a composition represented by $(LR_{1-x}HR_x)_2T_{14}A$.

The composition of a main phase of an R—Fe—B type alloy sintered body is herein represented by the general formula $(LR_{1-x}HR_x)_2T_{14}A$, where T is either Fe alone or a mixture of Fe and at least one transition metal element other than Fe, A is either boron alone or a mixture of boron and carbon, LR is at least one light rare earth element, and HR is at least one heavy rare earth element. LR and HR will be herein labeled as "R" collectively.

The light rare earth element LR is preferably selected from the group consisting of La, Ce, Pr, Nd, Pm, Sm, Eu and Gd and preferably includes at least one of Nd and Pr. The heavy rare earth element HR is preferably selected from the group consisting of Y, Tb, Dy, Ho, Er, Tm, Yb and Lu and preferably includes at least one element selected from the group consisting of Dy, Ho and Tb. The mole fraction x, indicating, as an atomic ratio, how much of the light rare earth element LR is replaced with the heavy rare earth element HR, is preferably equal to or greater than about zero and less than about one. That is to say, the main phase of the R—Fe—B type alloy sintered body may include no heavy rare earth element HR.

Examples of the transition metal elements include Ti, V, Cr, Mn, Fe, Co and Ni. T is preferably either Fe alone or Fe that has been partially replaced with at least one of Ni and Co.

To realize a sintered magnet exhibiting excellent magnetic properties, each of the first and second fine powders preferably includes about 25 mass % to about 40 mass % of rare earth element(s) R (where $R=LR_{1-x}HR_x$) and about 0.6 mass % to about 1.6 mass % of A. The balance of the first or second fine powder, other than R and A, includes T, a very small amount of additive(s) and inevitably contained impurities. The very small amount of additive(s) is preferably at least one element selected from the group consisting of Al, Cu, Ga, Cr, Mo, V, Nb and Mn. The total amount of the additive(s) is preferably about 1 mass % or less. Each of the rare earth alloy sintered body and the alloy block of the rare earth alloy material preferably includes a compound represented by $(LR_{1-x}HR_x)_2T_{14}A$ at about 80 vol % or more. It should be noted that the alloy block, obtained by cooling and solidifying a melt of the rare earth alloy material, normally has an oxygen content of about 1,000 ppm or less on a mass basis. This is because the alloy block has not gone through the sintering process yet.

In the method of making a sintered body for a rare earth magnet according to this preferred embodiment of the present invention, the second fine powder is used to make the sintered body for a rare earth magnet after having been mixed with the first fine powder that has been made from the rare earth alloy sintered body. Unlike the prior art, the second fine powder does not have to have a special composition and can be used to make the sintered body for a rare earth magnet by itself.

In this case, the second fine powder may be either the same as, or different from, a fine powder that was used to make the rare earth alloy sintered body to be a material for the first fine powder. The reason is as follows. Generally speaking, the alloy composition of a rare earth alloy sintered body is adjusted to various applications. Accordingly, in a manufacturing factory, rare earth alloy sintered bodies of various grades are produced. For example, by changing the mole fraction x in the general formula described above, a number of different types of rare earth alloy sintered bodies, exhibiting mutually different remanences $B_r$ or coercivities $iH_c$, can be produced. For that purpose, alloy blocks, having mutually different x mole fractions associated with those grades, are prepared in the manufacturing factory to obtain a rare earth alloy sintered body of the desired grade. Thus, there are alloy blocks and sintered bodies of various grades (i.e., good and bad products) in the manufacturing factory. In this preferred embodiment, the materials of the first and second fine powders may be either of the same grade or of mutually different grades. In any case, to achieve good enough magnetic properties, falling within the desired ranges, for the rare earth sintered magnet in the end, the compositions and the mixing ratio of the first and second fine powders need to be controlled appropriately.

It should be noted, however, that the composition of a sintered body is usually somewhat different from that of its fine material powder. This is because the constituents (the rare earth element(s) thereof, in particular) of the material powder are oxidized during the sintering process, for example. The first fine powder, obtained by pulverizing the sintered body, tends to exhibit low liquid phase sinterability because the rare earth elements thereof have been oxidized and consumed. Thus, in the conventional recycling methods described above, the alloy B (as described in Japanese Patent Publication No. 2746818) or the composition controlling alloy powder (as described in Japanese Laid-Open Publication No. 11-329811) is mixed to compensate for the low sinterability of that recycled material obtained by pulverizing the sintered body.

In contrast, according to preferred embodiments of the present invention, if the recycled material exhibits low sinterability, then the mass percentage (i.e., the mixing ratio) of the first fine powder relative to the second fine powder is reduced. More specifically, in the mixed powder, the mass of the first fine powder preferably corresponds to about 0.1% to about 10% of that of the second fine powder. The reason is as follows. If the mass percentage of the first fine powder (i.e., fine powder of the recycled material) relative to the second fine powder (i.e., fine powder of a brand new material) is equal to about 10 mass % or less, then the sinterability (e.g., the sintered density) of the mixed powder will be high enough to produce a sintered magnet with practical magnetic properties. However, once the mass percentage of the first fine powder relative to the second fine powder exceeds about 10 mass %, the sinterability of the mixed powder declines, thus decreasing the sintered density and increasing the oxygen content of the sintered body. As a result, the remanence $B_r$ or coercivity $iH_c$ of the sintered body may decrease. On the other hand, if the mass percentage of the first fine powder relative to the second fine powder is too low, then the recycling will not be so advantageous particularly in terms of the cost effectiveness. For that reason, the mass percentage of the first fine powder relative to the second fine powder is preferably at least equal to or greater than about 0.1 mass %.

If the mole fraction x in the main phase of the first fine powder as represented by the general formula is different from that in the main phase of the second fine powder as also represented by the same formula (i.e., if the first fine powder is obtained from a sintered body of a different grade), then the mass percentage of the first fine powder relative to the second fine powder is preferably less than about 5 mass %, more preferably less than about 3 mass % to achieve sufficiently good magnetic properties. It should be noted that the first and/or second fine powder(s) may be made up of a plurality of powders with mutually different compositions. In that case, before those powders with different compositions are mixed either as coarse powders or as fine powders, the compositions of those powders are preferably analyzed and the mixing ratio thereof is preferably determined based on the result of the composition analysis. The resultant sintered body for a rare earth magnet preferably includes the rare earth element(s) R at about 34 mass % or less, more preferably at about 33 mass % or less.

Next, it will be described specifically how to prepare the first fine powder from the rare earth alloy sintered body in the method of making a sintered body for a rare earth magnet according to this preferred embodiment of the present invention.

To obtain the first fine powder from the rare earth alloy sintered body, first, the rare earth alloy sintered body is coarsely pulverized. Normally, when a fine powder is obtained from an alloy block or flake, the alloy block or flake is also coarsely pulverized once and then finely pulverized. This is done to obtain a fine powder having a desired particle size distribution efficiently because a rare earth alloy powder often has low compactability. As the methods of coarse pulverization, a hydrogen pulverization process or a mechanical milling process is usually used. In the manufacturing process of this preferred embodiment, the sintered body is coarsely pulverized by a hydrogen pulverization process. In the hydrogen pulverization process, the rare earth element is hydrogenated, and therefore, will not be oxidized in the subsequent manufacturing and processing steps so much as other mechanical milling processes. As a result, even though the rare earth alloy sintered body is recycled as a magnet material, the oxygen content of the resultant powder will not increase so much. Also, in the sintering process, the hydrogenated rare earth element will be dehydrogenated to turn into a metal and enter a liquid phase. As a result, the sinterability thereof also increases. Furthermore, according to the hydrogen pulverization process, the productivity of the coarse and fine pulverization processes is several times as high as that of the mechanical milling process. The hydrogen pulverization process is preferably carried out by exposing the rare earth alloy sintered body to a hydrogen gas atmosphere at a pressure of about 1 MPa or less for about 0.5 hour to about 10 hours.

The hydrogen pulverization process is a pulverization technique that utilizes the phenomenon that very small cracks are created in the rare earth alloy material (typically an alloy block) due to the volume expansion of the alloy material being exposed to a hydrogen gas atmosphere. This expansion is caused by the hydrogenation of the rare earth element in the alloy material. Accordingly, it has been believed that it is difficult to successfully apply this technique industrially to pulverizing a sintered magnet including a rare earth element that has already been partially oxidized. However, the present inventors discovered and confirmed via experiments that this hydrogen pulverization technique is also applicable sufficiently effectively to coarsely pulverizing such a sintered body. Also, to coarsely pulverize the sintered body more efficiently, the sintered body (with a specific gravity of about 7.5 g/cm$^3$, for example), to be subjected to the hydrogen pulverization process is preferably a block having a mass of about 50 g or less. This is because if each block of the sintered body is large enough to have a mass of greater than about 50 g (e.g., having approximate dimensions of 25 mm×24 mm×11 mm or more), then the sintered body may not be coarsely pulverized completely but unpulverized portions may be left at the center of the sintered body. Thus, to coarsely pulverize the sintered body completely, each block to be subjected to the hydrogen pulverization process preferably has a mass of about 25 g or less. If the defective sintered body to be pulverized has a weight of greater than about 50 g, then that sintered body is preferably crushed mechanically with a jaw crusher, for example.

The coarse powder (i.e., the first coarse powder) obtained by the hydrogen pulverization process is further milled mechanically if necessary using a disk mill, for example. Thereafter, the first coarse powder is finely pulverized by a dry milling technique using a jet mill. The resultant fine powder (i.e., the first fine powder) preferably has a mean particle size of about 1.5 μm to about 7 μm. When such a dry milling process is carried out using a jet mill, fine powder particles, containing a lot of oxygen, are preferably removed partially.

The processing step of finely pulverizing the first coarse powder with a jet mill and the processing step of obtaining the second fine powder from a brand new material may be carried out simultaneously using the same machine. As described above, the second fine powder is obtained by performing the processing steps of coarsely pulverizing an alloy block having a predetermined composition by a hydrogen pulverization process, for example, further milling mechanically the resultant coarse powder (i.e., the second coarse powder) using a disk mill, for example, if necessary, and then finely pulverizing the second coarse powder by a dry milling technique using a jet mill. The second fine powder also preferably has a mean particle size of about 1.5 μm to about 7 μm. Accordingly, by dry-mixing the first and second coarse powders using a rocking mixer, for example, and then finely pulverizing the resultant mixture of the coarse powders using the jet mill, a mixed powder of the first and second fine powders can be obtained. It should be noted that in the dry-mixing and finely pulverizing processing steps, a lubricant may be added to the powders when needed so that the surface of the first and second fine powders is coated with the lubricant.

It is naturally possible to obtain a mixture of the first and second coarse powders by the same hydrogen pulverization process and then obtain the mixture of the first and second fine powders by the same dry milling process. That is to say, the material of the first coarse powder (e.g., a block of a sintered body) and the material of the second coarse powder (e.g., a block of a strip cast alloy) may be mixed with each other in advance, and then the mixture may be subjected to the hydrogen pulverization process to obtain the mixture of the first and second coarse powders. In any case, to minimize the unwanted oxidation, these materials are preferably mixed with each other before pulverized into the first and second fine powders.

The material (i.e., the alloy block having the predetermined composition) of the second fine powder is preferably prepared by a quenching process. This is because if the second fine powder is obtained from a rapidly solidified alloy block (or flake), then not only the magnetic properties but also the sinterability of the second fine powder are excellent. Accordingly, the second fine powder can effectively compensate for the low sinterability of the first fine powder. The second fine powder, obtained from a rapidly solidified alloy block, exhibits superior sinterability probably because an R-rich phase should be dispersed on the surface of the second fine powder more thinly and broadly than a fine powder obtained from an ingot alloy that had been cast into a mold.

Also, the first and second fine powders preferably have low oxygen contents. This is because if the oxygen contents thereof are too high, the desired magnetic properties may be unachievable even though the mixing ratio of the first and second fine powders falls within the above-specified range. Specifically, the first fine powder preferably has an oxygen content of about 1,500 ppm to about 10,000 ppm while the second fine powder preferably has an oxygen content of about 1,500 ppm to about 7,000 ppm. However, even if the oxygen content of the first fine powder exceeds this range, sufficiently good magnetic properties may be achieved by selecting a material having a low oxygen content as the second fine powder. Anyway, the mixing ratio of the first fine powder to the second fine powder is preferably determined in consideration of the desired magnetic properties.

Once the intended mixed powder is obtained, the subsequent manufacturing and processing steps may be performed by known techniques. Specifically, the mixed powder is pressed and compacted to obtain a compact in a desired shape. Next, the compact is subjected to a binder removal process, if necessary, a sintering process and an aging treatment, thereby obtaining a sintered body.

The mixed powder may be pressed and compacted using motorized presses at a compacting pressure of about 0.2 ton/cm$^2$ to about 2.0 ton/cm$^2$ (i.e., from about $1.96\times10^4$ kPa to about $1.96\times10^5$ kPa) while being aligned with an orienting magnetic field of about 0.2 MA/m to about 4 MA/m.

Next, the resultant compact is sintered at a temperature of about 1,000° C. to about 1,100° C. for approximately 1 hour to approximately 5 hours either within an inert gas (e.g., rare gas or nitrogen gas) atmosphere or within a vacuum. The sintered body obtained is then subjected to an aging treatment at a temperature of about 450° C. to about 800° C. for approximately 1 hour to approximately 8 hours. Optionally, the aging treatment may be omitted. In this manner, an R—Fe—B type alloy sintered body is obtained. Also, to reduce the amount of carbon included in the sintered body and thereby improve the magnetic properties thereof, the lubricant that covers the surface of the alloy powder may be heated and evaporated before the green compact is sintered. The conditions of this lubricant heating/evaporating processing step (i.e., binder removal processing step) may change with the type of the lubricant. For example, this processing step may be performed at a temperature of about 100° C. to about 600° C. for approximately 0.5 hour to approximately 6 hours within a reduced pressure atmosphere. It should be noted that if the green compact is held at a temperature of about 800° C. to about 950° C. for approximately 0.1 hour to approximately 2.0 hours before being sintered at a temperature of about 1,000° C. to about 1,100° C., then hydrogen may be released from the green compact including the hydrogenated rare earth element. As a result, the green compact can have its sinterability improved.

Next, by magnetizing the resultant sintered body, a sintered magnet is completed. This magnetizing processing step may be performed at an arbitrary point in time after the sintering processing step is finished. If necessary, the sintered magnet is completed by being subjected to a finishing (e.g., chamfering) process and a surface treatment (e.g., plating). The sintered body for a rare earth magnet, made by the manufacturing process of this preferred embodiment, can exhibit magnetic properties comparable to those of a sintered body that has been made from the second fine powder (i.e., the powder of a brand new material) only.

Hereinafter, a method of making a sintered body for a rare earth magnet and a method for producing a sintered magnet according to preferred embodiments of the present invention will be described by way of specific examples. It should be noted that the present invention is in no way limited to the following illustrative examples.

A first fine powder (i.e., powder of a recycled material) was made from a defective rare earth alloy sintered body (with a weight of about 500 g and approximate dimensions of 50 mm×38 mm×35 mm). In this specific example, the sintered body was crushed mechanically with a jaw crusher before being subjected to a hydrogen pulverization process. Then, the resultant blocks were classified into multiple groups (i.e., Samples Nos. 1 through 5) by their masses and each group of blocks was coarsely pulverized by a hydrogen pulverization process, in which the blocks were held within a hydrogen gas atmosphere at a pressure of about 0.2 MPa for approximately 3 hours. Next, the resultant coarse powder was further milled using a disk mill having a gap width of about 0.3 mm, for example. Thereafter, the milled powder was finely pulverized with a jet mill to a mean particle size of about 4.5 μm. In this manner, the first fine powder was obtained. Each of the samples Nos. 1 to 5 shown in the following Table 1 was the first fine powder that had been obtained in this manner.

TABLE 1

| Sample No. | Mass of blocks (g) (dimensions: mm × mm × mm) | Sintered Density (g/cm$^3$) | Remanence $B_r$ (T) | Coercivity iHc (kA/m) |
|---|---|---|---|---|
| 1 | 250 (40 × 30 × 28) | 7.42 | 1.15 | 1476 |
| 2 | 100 (30 × 30 × 15) | 7.48 | 1.16 | 1496 |
| 3 | 70 (30 × 28 × 11) | 7.55 | 1.17 | 1515 |

TABLE 1-continued

| Sample No. | Mass of blocks (g) (dimensions: mm × mm × mm) | Sintered Density ($g/cm^3$) | Remanence $B_r$ (T) | Coercivity iHc (kA/m) |
|---|---|---|---|---|
| 4 | 50 (25 × 24 × 11) | 7.55 | 1.17 | 1560 |
| 5 | 25 (20 × 20 × 8) | 7.55 | 1.17 | 1576 |
| 6 | — | 7.55 | 1.17 | 1578 |

It should be noted that a sample sintered body that was subjected to the hydrogen pulverization process without having been crushed mechanically beforehand could not be pulverized completely. Thus, an unpulverized portion (core) remained around the center of the sintered body.

As an alloy block to make a second fine powder therefrom, an alloy flake having a predetermined composition was prepared by a strip casting process. The alloy flake had an oxygen content of about 320 ppm. The alloy flake was pulverized by the hydrogen pulverization process, thereby obtaining a second coarse powder. Next, the second coarse powder was further milled with the disk mill and then finely pulverized with the jet mill. In this manner, a second fine powder having a mean particle size of about 4.5 μm was obtained. It should be noted that the jet milling processing step to obtain the first and second fine powders was carried out within a nitrogen gas atmosphere having a very low oxygen content to reduce the oxidation of the rare earth element. It should also be noted that the sintered body, which was used as a material of the first fine powder, was made from a fine powder that had been prepared by the same manufacturing and processing steps as those performed to obtain the second fine powder. A pulverization process using a jet mill is disclosed in Japanese Laid-Open Publication No. 2002-33206 and U.S. Pat. No. 6,491,765, which are hereby incorporated by reference.

The compositions of the first and second fine powders obtained in this manner are shown in the following Table 2:

TABLE 2

| Sample | R (Nd + Pr) | Dy | Co | B | Al | Cu | O | C |
|---|---|---|---|---|---|---|---|---|
| 1st fine powder | 29.2 | 2.6 | 0.9 | 1.0 | 0.2 | 0.1 | 6200 ppm | 550 ppm |
| 2nd fine powder | 28.5 | 3.3 | 0.9 | 1.1 | 0.3 | 0.15 | 5000 ppm | 450 ppm |

It should be noted that the composition of the first fine powder was obtained by analyzing the composition of the powder that had just been milled by the disk mill. All of the samples Nos. 1 to 5 had approximately the same composition and the difference between them fell within the tolerance. In Table 2, the numerical values representing the compositions are indicated in mass percentages and the balance of the first or second fine powder, which is not described on Table 2, includes Fe and inevitably contained impurities.

Next, each of the samples Nos. 1 to 5 of the first fine powder was mixed with the second fine powder in such a manner that the mass of the first fine powder corresponded to about 5% of that of the second fine powder. Then, a sintered body was made from this mixed powder. Another sintered body was also made as sample No. 6 from the second fine powder only.

After the compaction process was finished, the subsequent manufacturing and processing steps were carried out under the following conditions.

Specifically, the mixed powders (corresponding to samples Nos. 1 to 5) and the second fine powder (sample No. 6) were pressed and compacted at a compacting pressure of about 0.8 ton/$cm^2$ (equivalent to about $7.84\times10^4$ kPa) under an orienting magnetic field of about 0.96 MA/m (equivalent to about 1.2 T) applied, thereby obtaining green compacts with a vertical size of about 40 mm, a horizontal size of about 30 mm and a height of about 20 mm. The orienting magnetic field was applied substantially perpendicularly to the compacting direction. Subsequently, these green compacts were held at about 900° C. for approximately 1 hour within a reduced pressure Ar atmosphere to remove hydrogen therefrom, and then sintered at about 1,050° C. for approximately 4 hours. Thereafter, the sintered bodies were subjected to an aging treatment at about 500° C. for approximately 1 hour. Finally, these sintered bodies were machined into test samples with approximate dimensions of 5.4 mm×12 mm×12 mm. Next, using a B-H tracer, the magnetic properties of the resultant sintered magnets were evaluated. The densities and magnetic properties of the resultant sintered magnets (or compacts) are also shown in Table 1.

As can be seen from the results shown in Table 1, when the mass of the sintered body blocks to be subjected to the hydrogen pulverization process exceeded about 50 g, the magnetic property (i.e., the coercivity) thereof deteriorated. And when the mass of the sintered body blocks was further increased to more than about 70 g, the sintered density also decreased. The reason why the sintered density and the magnetic property decreased is believed to be that the unexpected coarse powder should have been mixed into the fine powder to deteriorate the sinterability and produce excessively large crystal grains. In contrast, if the mass of the sintered body blocks was about 50 g or less, the resultant magnetic properties were comparable to those obtained by using the second fine powder only. And when the mass of the sintered body blocks was decreased to about 25 g or less, the resultant magnetic properties were substantially the same as those realized by using the second fine powder only. As is clear from these results, the sintered body blocks to be subjected to the hydrogen pulverization process preferably have a mass of about 50 g or less, more preferably about 25 g or less. Specifically, when the mass of the sintered body blocks is about 50 g or less, the sintered body blocks can be pulverized almost to the core by the hydrogen pulverization process. As a result, no hard coarse powder particles will be left in the fine powder to be obtained by the subsequent finely pulverizing processing step using a jet mill, for example. If necessary, the processing step of removing those coarse powder particles, which might be left even after the finely pulverizing processing step, may also be performed additionally. It should be noted that the sintered body normally includes about 3,500 ppm to about 6,500 ppm of oxygen by weight.

Furthermore, the crystal grains (i.e., the main phase) of the sintered body preferably have a size of about 20 μm or less. This is because if the crystal grains of a sintered body have a size of greater than about 20 μm, then the coarse powder of such a sintered body cannot be pulverized finely enough by the jet mill, for example.

The results shown in Table 1 were obtained when the mixing ratio of the first fine powder to the second fine powder was about 5 mass %. The following Table 3 shows how the density and the magnetic properties of the sintered body changed with the mixing ratio.

TABLE 3

| Mixing ratio | Sintered density ($g/cm^3$) | Remanence $B_r$ (T) | Coercivity iHc (kA/m) |
|---|---|---|---|
| 15 mass % | 7.51 | 1.15 | 1498 |
| 10 mass % | 7.53 | 1.17 | 1561 |
| 5 mass % | 7.55 | 1.17 | 1576 |
| 0 mass % | 7.55 | 1.17 | 1578 |

In Table 3, the sample No. 5 shown in Table 1 was used as the first fine powder. As can be clearly seen from the results shown in Table 3, when the mixing ratio exceeded about 10 mass %, the sintered density and the magnetic properties both decreased. On the other hand, if the mixing ratio was about 10 mass % or less, the resultant magnetic properties were almost the same as those obtained by using the second fine powder only.

Various preferred embodiments of the present invention described above provide a method of making a sintered body for a rare earth magnet while recycling a defective rare earth alloy sintered body more efficiently. In the method of making a sintered body for a rare earth magnet according to the preferred embodiments of the present invention, there is no need to prepare a rare earth alloy having a special composition for the purpose of using a recycled material powder (i.e., the first fine powder) obtained by pulverizing the defective rare earth alloy sintered body. Thus, the preferred embodiments of the present invention can be carried out easily without complicating the current manufacturing process.

It should be understood that the foregoing description is only illustrative of the present invention. Various alternatives and modifications can be devised by those skilled in the art without departing from the invention. Accordingly, the present invention is intended to embrace all such alternatives, modifications and variances which fall within the scope of the appended claims.

The invention claimed is:

1. A method of making a sintered body for a rare earth magnet, the method comprising the steps of:

(a) preparing a first coarse powder by coarsely pulverizing a rare earth alloy sintered body by a hydrogen pulverization process;

(b) preparing a first fine powder by finely pulverizing the first coarse powder;

(c) preparing a second fine powder by pulverizing an alloy block of a rare earth alloy material; and (d) sintering a mixed powder including the first and second fine powders; wherein each of the first and second fine powders includes a main phase having a composition represented by the general formula: $(LR_{1-x}HR_x)_2T_{14}A$, where T is either Fe alone or a mixture of Fe and at least one transition metal element other than Fe; A is either boron alone or a mixture of boron and carbon; LR is at least one light rare earth element; HR is at least one heavy rare earth element; and $0 \leqq x < 1$.

2. The method of claim 1, wherein the steps (b) and (c) respectively include the steps of preparing the first and second fine powders each including about 25 mass % to about 40 mass % of rare earth element(s) R (where $R=LR_{1-x}HR_x$) and about 0.6 mass % to about 1.6 mass % of A.

3. The method of claim 1, wherein the steps (a) and (c) include the steps of preparing the rare earth alloy sintered body and the step of preparing the alloy block of the rare earth alloy material, respectively, the rare earth alloy sintered body and the alloy block of the rare earth alloy material each including a compound represented by $(LR_{1-x}HR_x)_2T_{14}A$ at about 80 vol % or more.

4. The method of claim 1, further comprising the step of making the mixed powder in which the mass of the first fine powder corresponds to about 0.1% to about 10% of the mass of the second fine powder.

5. The method of claim 4, wherein the steps (b) and (c) respectively include the steps of preparing the first and second fine powders such that a mole fraction x in the formula representing the main phase of the first fine powder is different from a mole fraction x in the formula representing the main phase of the second fine powder, and the method further comprises the step of making the mixed powder in which the mass of the first fine powder corresponds to less than about 5% of the mass of the second fine powder.

6. The method of claim 1, wherein the step (a) includes the steps of:

crushing the rare earth alloy sintered body into a plurality of blocks, each having a mass of about 50 g or less; and coarsely pulverizing each said block by the hydrogen pulverization process.

7. The method of claim 1, wherein the step (c) includes the steps of:

preparing a second coarse powder by coarsely pulverizing the alloy block of the rare earth alloy material; and producing the second fine powder by finely pulverizing the second coarse powder; wherein the method further comprises the steps of:

making a mixed powder of the first and second coarse powders; and producing the mixed powder of the first and second fine powders by finely pulverizing the mixed powder of the first and second coarse powders.

8. The method of claim 1, wherein the step (c) includes the steps of:

preparing a second coarse powder by coarsely pulverizing the alloy block of the rare earth alloy material; and producing the second fine powder by finely pulverizing the second coarse powder; wherein the method further comprises the steps of:

subjecting a mixture of the alloy block of the rare earth alloy material and the rare earth alloy sintered body to the hydrogen pulverization process to make a mixed coarse powder of the first and second coarse powders; and producing the mixed powder of the first and second fine powders by finely pulverizing the mixed coarse powder.

9. The method of claim 1, wherein the step (c) includes the step of preparing the alloy block by solidifying a melt of the rare earth alloy material by a quenching process.

10. The method of claim 1, wherein the step (a) includes the step of coarsely pulverizing a defective sintered body for a rare earth magnet as the rare earth alloy sintered body.

* * * * *